US008817443B2

(12) United States Patent
Gao et al.

(10) Patent No.: US 8,817,443 B2
(45) Date of Patent: Aug. 26, 2014

(54) RESIDUAL CURRENT PROTECTION DEVICE

(75) Inventors: Xinxia Gao, Beijing (CN); Wei Jiang, Beijing (CN); Lizhong Ji, Beijing (CN)

(73) Assignee: ABB SpA, Milan (IT)

( * ) Notice: Subject to any disclaimer, the term of this patent is extended or adjusted under 35 U.S.C. 154(b) by 4 days.

(21) Appl. No.: 13/635,713

(22) PCT Filed: Apr. 14, 2010

(86) PCT No.: PCT/CN2010/071757

§ 371 (c)(1), (2), (4) Date: Sep. 18, 2012

(87) PCT Pub. No.: WO2011/127654

PCT Pub. Date: Oct. 20, 2011

(65) Prior Publication Data

US 2013/0021711 A1 Jan. 24, 2013

(51) Int. Cl.

| | |
|---|---|
| ***H01H 73/00*** | (2006.01) |
| ***H01H 9/46*** | (2006.01) |
| ***H01H 9/34*** | (2006.01) |
| ***H01H 9/30*** | (2006.01) |
| *H01H 83/04* | (2006.01) |
| *H01H 9/44* | (2006.01) |
| *H01H 83/22* | (2006.01) |

(52) U.S. Cl.

CPC ..... *H01H 9/302* (2013.01); *H01H 83/04* (2013.01); *H01H 9/44* (2013.01); *H01H 9/46* (2013.01); *H01H 9/341* (2013.01); *H01H 83/226* (2013.01); *H01H 9/342* (2013.01)

USPC ..... 361/115

(58) Field of Classification Search

USPC ..... 361/115

See application file for complete search history.

(56) References Cited

U.S. PATENT DOCUMENTS

| | | | | |
|---|---|---|---|---|
| 5,629,506 | A * | 5/1997 | Harris et al. | 218/48 |
| 5,847,630 | A * | 12/1998 | Arnold et al. | 335/35 |
| 7,541,902 | B2 * | 6/2009 | Domejean et al. | 335/201 |
| 2002/0175786 | A1 * | 11/2002 | Wellner et al. | 335/16 |
| 2007/0085638 | A1 * | 4/2007 | Zindler | 335/132 |
| 2009/0057273 | A1 * | 3/2009 | Kil | 218/149 |
| 2010/0264928 | A1 * | 10/2010 | Zende et al. | 324/424 |
| 2013/0200046 | A1 * | 8/2013 | Demandt et al. | 218/156 |

FOREIGN PATENT DOCUMENTS

| | | | |
|---|---|---|---|
| CN | 2268306 | Y | 11/1997 |
| CN | 101447346 | A | 6/2009 |
| CN | 201327992 | Y | 10/2009 |
| JP | 2002352692 | A | 12/2002 |

OTHER PUBLICATIONS

ISA/CN International Search Report re PCT Application No. PCT/CN2010/071757, Dated Jan. 20, 2011.

IPEA/CN International Preliminary Report on Patentability re PCT Application No. PCT/CN2010/071757, Dated Jul. 11, 2012.

* cited by examiner

*Primary Examiner* — Ronald W Leja

(74) *Attorney, Agent, or Firm* — Patrick J. Daugherty; Driggs, Hogg, Daugherty & Del Zoppo Co., LPA

(57) ABSTRACT

A residual current protection device comprises: an arc guiding plate, which is configured to guiding an arc generated during contacts breaking to an arc extinguishing unit. Wherein, the arc extinguishing unit includes an arc extinguishing channel, configured to extinguish the arc; and an enhanced arc extinguisher, disposed between the extinguishing channel and the arc guiding plate, for impelling the arc into the extinguishing channel.

19 Claims, 4 Drawing Sheets

RESIDUAL CURRENT PROTECTION DEVICE

RELATED APPLICATION

This application is a national filing of PCT application Serial No. PCT/CN2010/071757, filed Apr. 14, 2010.

TECHNICAL FIELD

The invention relates to a residual current device (RCD). More specifically, the invention relates to a Miniature Circuit Breaker (MCB) with residual current protection function. The proposed device has a simplified structure, with good performance of arc extinguishing and less influenced by surge voltage from power supply.

BACKGROUND ART

A stricter requirement was imposed on the safety and reliability of industrial and civil power supply along with the development of technology. According to some related national standards, a better EMC capability shall be provided by the low voltage electrical equipments and the power supply lines. In view of this technical tendency and development, a new design of residual current device which provides better protection to user and connected equipments is necessary.

An ordinary circuit breaker, such as MCB, usually has a mechanism of overload protection and short circuit protection. Different from the ordinary circuit breaker, a residual current device (RCD) has a mechanism for residual current protection besides from the overload protection and short circuit protection. The RCD detects residual current in the power supply line and then compares the detected current value with a pre-determined residual current threshold. The RCD disconnects the protected power line when the detected value is higher than the pre-determined value, in order to prevent the user and electrical equipments from being destroyed by the residual current.

Specifically, a RCD operates by measuring the current balance between two power lines, e.g., a live wire and a neutral wire, using a differential current transformer. It measures the values of the current flowing out the live wire and the current returning through the neutral wire. If the values of input and output current do not sum to zero, there is a leakage of current to ground or to another circuit, and the device will activate its residual current protection mechanism and break its electrical contacts.

A typical electronic RCD includes an operating mechanism for breaking and closing the contacts of power lines, a magnetic releasing unit, a heat releasing unit, a zero sequence transformer, a magnet, an electronic circuit and a housing for enclosing all the components. In the existing RCD, every component only implements its task for a single purpose besides acting as a current carrier. The single-purpose component design used in the existing devices makes the structure thereof less complicate and easy to manufacture. On the other hand, the assembling procedure of existing device is quite complicate, low efficient, unreliable and risky due to the huge amount of single purpose components needed by the device. Moreover, it was also found that the existing RCD does not have a good performance of arc extinguishing, and it is also vulnerable to the influence from surge voltages occurred on power lines.

In order to solve the problems of the existing RCD, the RCD proposed in present invention adopts a newly designed component with multi-purposes. The proposed RCD also improves the performance of arc extinguishing and anti-surge voltage.

BRIEF SUMMARY OF THE INVENTION

According to one embodiment of the invention, it is provided a residual current protection device, which comprises an arc guiding plate and an arc extinguishing unit. The guiding plate is configured to guiding an arc generated during contacts breaking to the arc extinguishing unit. Wherein, the arc extinguishing unit includes an arc extinguishing channel configured to extinguish the arc; and an enhanced arc extinguisher disposed between the extinguishing channel and the arc guiding plate, for impelling the arc into the extinguishing channel.

According to another embodiment of the invention, the enhanced arc extinguisher includes an arc extinguishing plate. And the arc extinguishing plate is configured to generate gas in a high temperature, in order to increase the internal pressure of the protection device.

According to another embodiment of the invention, the enhanced arc extinguisher includes a protruding portion on inside surface of a housing of the protection device. A magnetic field reinforcing element is disposed within the protruding portion. And the magnetic field reinforcing element is configured to reinforce the magnetic field generated along with the arc, which accelerates the arc moving into the extinguishing channel.

According to another embodiment of the invention, the device also comprises an arc guiding plate, which is configured to integrate with a current input terminal; and a static contact, which is configured to integrate with a current output terminal.

According to another embodiment of the invention, the device also comprises an insulting wall separates the arc extinguisher with the PCB; and a gas dissipating channel on the housing of protection device, which is configured to dissipate the gas generated by the arc extinguishing plate.

According to another embodiment of the invention, the device also comprises, a testing button, which is configured to test residual current protection of the protection device; a PCB, which is configured to detect the residual current and compare the detected value with a pre-determined value; and a power supplying unit for supplying power to the PCB, which is configured to turn off the power supply to PCB when the residual current protection device is turned off.

According to another embodiment of the invention, the PCB includes: a main voltage releasing element and a secondary voltage element. The main voltage releasing element is configured to have a high inductive reactance in high frequency. The secondary voltage releasing element is configured to connect with the main voltage releasing element in series. And a residual current detecting and comparing unit are configured to connect with the secondary voltage releasing element in parallel.

According to another embodiment of the invention, wherein, the main voltage releasing element is a magnet; and the secondary voltage releasing element is a variable resistor.

BRIEF DESCRIPTION OF THE DRAWINGS

Further embodiments, advantages and applications of the invention are disclosed in the claims as well as in the following description, which makes reference to the accompanied FIG. 1-7, wherein:

PREFERRED EMBODIMENTS OF THE INVENTION

Figure 1:
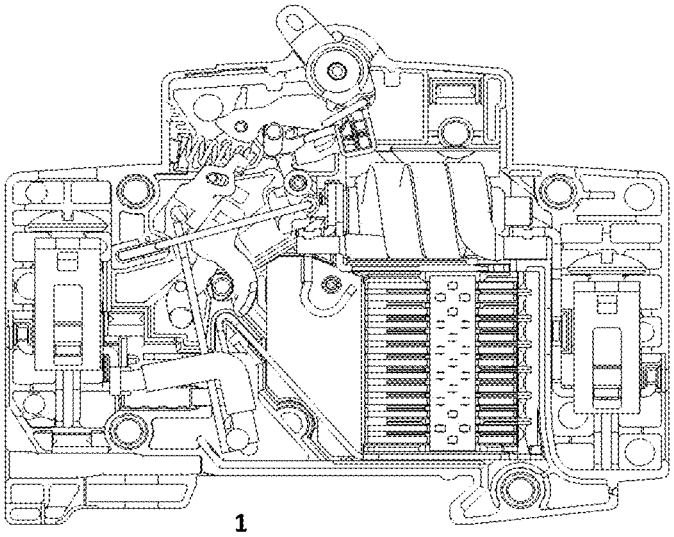
FIG. 1 is a schematically sectional view of the RCD at the circuit breaker side.

FIG. 1 shows the overall assembly view of a RCD according to one preferred embodiment of the invention. The RCD can be divided into two main portions, that is, a MCB module and a residual current protection module. FIG. 1 is a schematic drawing for the internal structure of the device 1 when it is viewing at the MCB side. The structure of MCB portion is similar to an existing MCB device and the detailed description for this part is thereof omitted. The following paragraphs will focus on the structure and functions of the residual current protection module.

Figure 2:
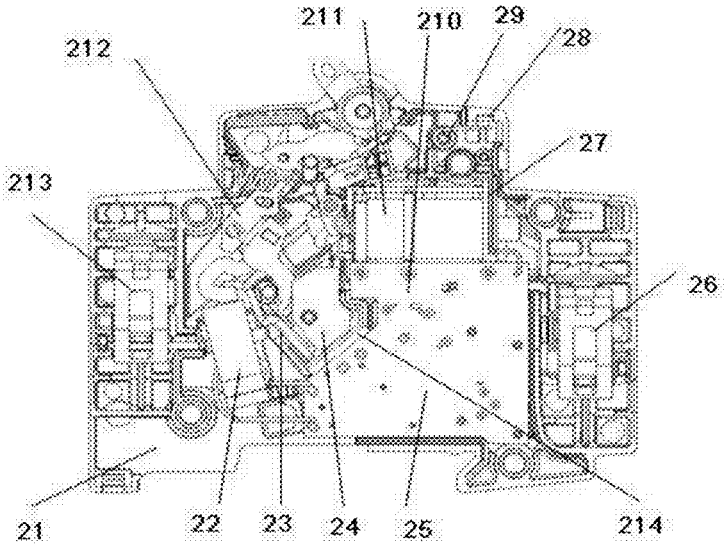
FIG. 2 is a schematically sectional view of the RCD at the residual current device side.

FIG. 2 shows an assembly view of the RCD at the residual current protection module side. As shown in the figure, the RCD includes the following main components: a housing 21, a left terminal module 213, an operating mechanism 212, a magnet 211, an electrifying spring 210, a torsion spring 29, a residual current protection testing button 28, a contact spring 27, a right terminal module 26, a Print Circuit Board (PCB) 25, a RCD arc extinguishing plate 24, a RCD arc guiding plate 23 and a zero sequence transformer 22.

In an embodiment, a current fed from external power supply flows into the

RCD from the left terminal module 213 and flow out of the device through right terminal module 26. That is, the current flows from left side to right side as shown on the figure. The left terminal and right terminal are used as power input and output of the whole device respectively. The parts different from those of existing technology are described in the following paragraphs.

RCD ARC Guiding Plate

An arc guiding plate 23 is used to guide the arc generated during contacts breaking into an area for extinguishing the arc. An existing arc guiding plate usually includes several separate pieces. For example, it may include three separate pieces: an input terminal for connecting to the power supply, an arc guiding component, and a flexible or rigid conductor for connecting the input terminal and guiding component. As discussed above, every piece of the arc guiding component itself is simple in structure, however, the assembling procedure for the whole unit is relatively complicate, and the large amount of separate parts significantly decreases the manufacturing efficiency.

Figure 3:
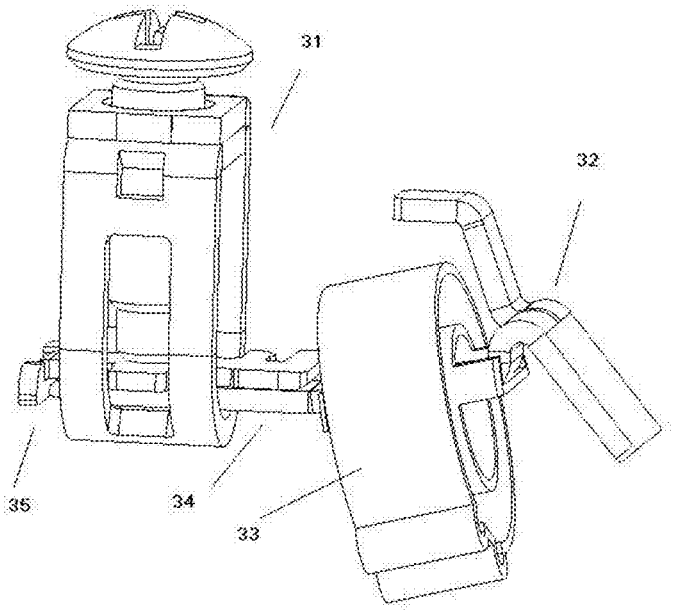
FIG. 3 is a schematic view of the arc guiding plate of the RCD according to one preferred embodiment.

In present invention, the RCD arc guiding plate is designed as one piece. As shown in FIG. 2, the arc guiding plate 23 is inserted into the left terminal module 213 through zero sequence transformer 22. As shown in FIG. 3, the left terminal 31 and zero sequence transformer 33 divide the arc guiding plate into three portions, 32, 34, and 35. All of the three portions correspond to one separate part in the existing technology, which are the input terminal, the connecting conductor, and the guiding component. The RCD according to present embodiment integrates above three components into a single piece and implements all functions of the separate components in together. The manufacturing efficiency is thereby improved, and heat generation during operating time can be reduced by decreasing the number of the components.

ARC Extinguishing Unit

In the procedure of breaking an electrical connection, an arc will generate if the current to be broke exceeds a threshold. In practice, an actual arc generating threshold is dependent to the material of the electrical contacts. The arc prolongs the time needed to break an electrical connection or even make it impossible to break the connection, which will finally leads to an accident. Therefore, the capability of arc extinguishing is an essential parameter of the circuit breaking device.

In an existing RCD device, it has no arc extinguishing plate or extinguishing space due to its limited internal space. This makes an existing RCD with poor extinguishing capability. The present RCD deploys an enhanced extinguishing component, which consumes very few internal spaces, and improves the arc extinguishing performance. By improving the extinguishing capability, it is possible to break a higher current.

Comparing with the electrical contacts of MCB module, the contacts of RCD module performs with a "closing in advance and breaking with delay" policy. Specifically, the electrical contacts of RCD close earlier than those of MCB when it is time for closing, and the contacts of RCD break later than those of the MCB when it is time for breaking. In the procedure of breaking, theoretically, no arc will be generated as long as the moving and static contacts of RCD take action later than their counterparts of MCB. However, in practice, it is difficult to ensure the delay between RCD contacts and MCB contacts due to the limited internal space of RCD. Therefore, the design of RCD extinguishing unit is extremely important for protecting the breaking device and other electrical equipments connected therewith. A better performance of breaking can be achieved by improving the performance of arc extinguishing.

Figure 4:
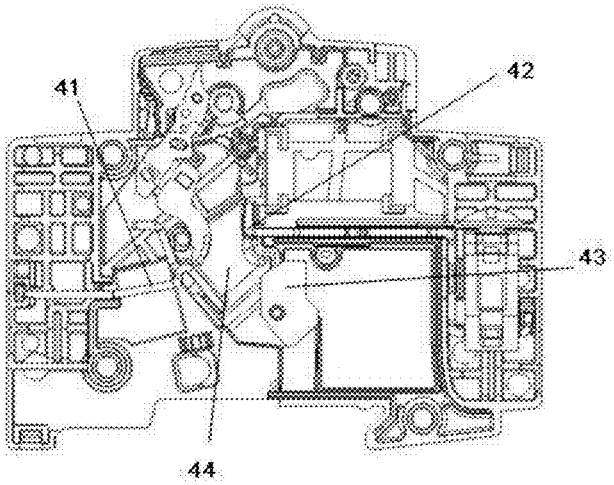
FIG. 4 is a schematic view of the arc extinguishing unit of the RCD according to one preferred embodiment.

As shown in FIG. 4, in a first embodiment, the RCD extinguishing unit includes an arc guiding plate 41, a RCD right terminal 42, and a RCD arc extinguishing plate 43. The extinguishing unit is disposed in a position between a dissipation channel on the rear side of the housing and the arc guiding plate.

In the case of short circuit, an arc is generated between the surface of the moving and static contacts. The arc then moves along the arc guiding plate 41 and RCD right terminal 42. Since the internal space of RCD is limited, the temperature in the internal space will increase rapidly. The surface of arc extinguishing plate 43 is cover with a material which generates gas in a high temperature. Alternatively, the extinguishing plate is made of the gas-generating material. In either way, lots of gas will be generated in the internal space of RCD when an arc was occurred between the contacts.

The generated gas will be release from the RCD through a dissipating channel at the rear of the housing (not shown on the figure). Considering the limited internal space and the amount of gas generated, the pressure in the internal space is quite high, and such a high pressure makes gas flowing out of the internal space soon. Therefore, the gas flow will blow and accelerate the arc moving into the dissipating channel and finally being extinguished.

According to the embodiment, the material adopted for generating gas is plastic. Other materials with such similar property of vaporizing in high temperature are also applicable to present invention. The generated gas also acts as a means of heat dissipation, which brings the heat out of the internal space of RCD to protect the electrified components therein.

In a second preferred embodiment, as shown in FIG. 4, an enhanced extinguishing component 44 is disposed between the arc guiding plate 41, the RCD right terminal 42 and the arc extinguishing plate 43. The enhanced extinguishing component 44 is a protruding area on the inside wall of RCD housing. The protruding area makes the limited internal space even smaller. Therefore, when the gas is generated at high temperature, the internal pressure of the chamber of RCD is even higher than that of the first embodiment. With a higher pressure in the RCD internal space, the gas flows out through the dissipating channel more quickly. With an accelerated gas flow, it is helpful to push the arc into the dissipating channel and being extinguished. Therefore, comparing with the first embodiment, the performance of arc extinguishing of the second embodiment is further improved.

In a third embodiment of the invention, the protruding portion on the inside wall of RCD includes at least two layers. Wherein, the bottom layer of the protruding portion is made of an iron material with a magnetic property, and its top layer is made of insulting material which protects electronic components from being destroyed by the arc.

During the process of separating electrical contacts, along with the arc generation, the electrical field thereof is also rapidly changed. Accordingly, a magnetic field will be generated in the surrounding area, and the iron plate embedded in the protrusive portion will enhance the magnetic field, which also accelerates the arc moving into the dissipating channel. The performance of arc extinguishing is therefore further improved.

In a fourth embodiment, as shown in FIG. 2, an insulated ridge 214 is formed on the inside surface of housing. The insulated ridge 214 extends between the arc extinguishing unit 214 and PCB 25. The insulated ridge 214 divides the internal space of the RCD into two chambers, one chamber for arc extinguishing and one chamber for PCB. The insulated ridge 214 prevents the arc from destroying the electronics on PCB 25.

Right Terminal

Similar to the existing arc guiding plate, the existing right terminal also includes several separate components. The right terminal according to one embodiment of present invention integrates all separate components of the existing right terminal into one piece.

Figure 5:
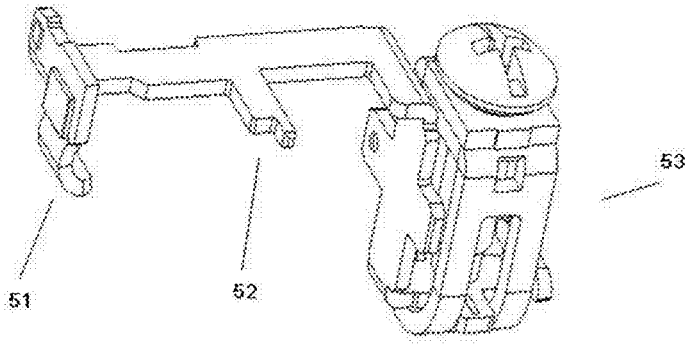
FIG. 5 is a schematic view of the right terminal of the RCD according to one preferred embodiment.

The RCD right terminal module shown in FIG. 5 combines several parts together, which includes: a static contact seat 51 for fixing the static contact, a conductor, a PCB power supply 52 for providing electricity to the PCB, and a right terminal 53 for outputting the current to external electrical equipment.

The RCD right terminal module shown in FIG. 5 combines several parts together, which includes: a static contact seat 51 for fixing the static contact, a conductor, a PCB power supply 52 for providing electricity to the PCB, and a right terminal 54 for outputting the current to external electrical equipments.

The RCD right terminal according to present invention accomplishes multiple purposes of those separate components via one single part, which reduces the use of flexible and rigid conductors.

PCB Power Supplier

Figure 6:
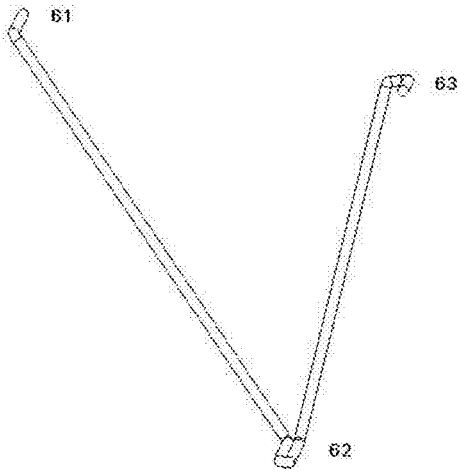
FIG. 6 is a schematic view of the component for supplying electricity to the Printed Circuit Board.

FIG. 6 shows the structure of a PCB power supplier located between the MCB module and RCD module. The supplier delivers electricity from MCB module to the PCB on RCD module. The PCB 10 will be electrified when the RCD is power on. The proposed PCB power supplier is constructed as a spring and has a shape of "V", which is simple to manufacture and use. The left end 61 of the spring connects with live wire of the electric supply; the right end 63 of the spring connects with the residual current testing button 28 and neutral wire; and the bottom end 62 connects with the PCB for power supply. By using the single component, it is possible to supply power to the testing button and PCB at the same time.

Specifically, the left end 61 and the bottom end 62 of spring are movable, which provide reliable electricity supply to the PCB. The right end 63 is static, and is used as a switch for residual current testing loop. The power supplying spring can be assembled with ease.

In an existing RCD, the PCB is always powered on, which will shorten the life of electronic components therein. However, according to the power supplying spring of present invention, the PCB is power-off when the RCD is in an open phase. Therefore, the electronic components on the PCB will be more durable.

As shown in FIG. 2, the power supplying spring is assembled into the RCD and can be divided into three parts in terms of different functions: an input spring 210, a contact spring 27 and a torsion spring 29. In the supplying spring of FIG. 3, the node for providing electricity connects with live wire of power line. Since the connection to live wire is controlled by the switch of RCD, the working status of PCB is in line with the whole RCD. That is, when the RCD is power-off, the PCB is also power-off. Since the neutral wire provides ground level, it may connect with the power supplying spring without any adverse effect to the components on PCB. Therefore, as long as the switch of RCD is open, all the components in the RCD are not electrified.

The user may want to know whether the residual current detection function of the device works properly by pressing the testing button 28. The input spring 210, contact spring 27 and torsion spring 29 form a loop for testing the residual current protection function. The testing loop simulates the current leakage by using the current from live wire. In present embodiment, the loop formed by testing button 28, torsion spring 29 and contact spring 27 is open unless the button is being pressed. When the testing button 28 is pressed down, the circuit switches into a closed status and the current flows from live wire to all components. Then the circuit generates a tripping signal to test the protect function. In present invention, since the live wire does not connect with the internal components when the RCD is off, the interference brought by live wire can be minimized

PCB and Electronic Components

The existing circuit breaker is vulnerable to the influence from surge voltage on external power line. Specifically, the surge voltage has a significant adverse influence on the semiconductors, circuit modules and variable resistors. The electronic circuit proposed in present invention improves the capability of anti-surging by modifying the structure of the circuit.

Figure 7:
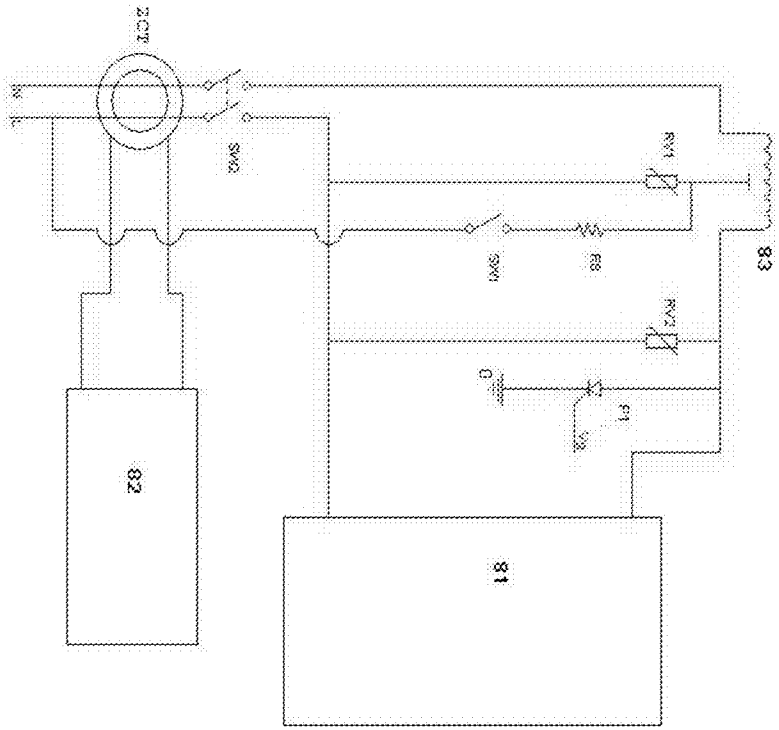
FIG. 7 is a schematic view of electronic circuits on the PCB according to one preferred embodiment.

As shown in FIG. 7, the electronic circuit includes: a magnet 83, two variable resistors RV1, RV2, a thyristor P1, a switch SW2 and a testing switch SW1, a resistor R8, a zero sequence transformer ZCT, a leakage protection unit 81 and a transformer output signal processing unit 82.

According to the embodiment in FIG. 7, the variable resistors RV1 and RV2 are disposed in parallel connection. The resistor RV2 connect with the magnet 83 in series, and resistor RV1 serially connects with the magnet through a tap on the magnet. That is, the RV2 serially connects with the whole magnet and the RV1 serially connects with a part of the magnet.

The testing button SW1 connects with resistor RV1 in parallel. The protection unit 81 connects with the variable resistors RV1 and RV2 in parallel. Therefore, the protection unit 81 has the same potential as that of the variable resistors. One end of thyristor P1 connects with the magnet and the other end connect to ground.

The power input/output terminals are live wire and neutral wire respectively. The zero sequence transformer ZCT is disposed closed to the input and output terminals. The value of voltage detected by the transformer is sent to the transformer processing unit 82. The switch SW2 connects or disconnects the components on the PCB with power line. When SW2 is closed, the components are power-on and start to operation. When the testing button SW1 is closed, an additional current is introduced to the circuit from live wire for performing residual current protection test.

A surge voltage came from the power supply line will impose, for example a 1.2/50 μs, surge voltage on the live wire input. In the circuit shown in FIG. 7, the generated surge voltage first flows through the variable resistors RV1 and RV2 in parallel. Then the current flow though the magnet 83 connected with the resistors respectively, and flows back to the neutral wire. Many high frequency components are included in the surging current, and the magnet 83 has a high inductive reactance to the high frequency components. Therefore, the magnet with high inductive reactance carries most part of the surge voltage, which is referred to as a first voltage release.

Since the magnet carries the most part of surge voltage, the variable resistors RV1 and RV2 only carry a small part of the voltage, which is referred to as a second voltage release. Since the variable resistors only carry with a relative low voltage, the resistors with a smaller size can be adopted in the circuit, which reduces the space consumed by circuit and still maintain a good anti-surging capability.

The surge voltage imposed on the thyristor P1 and protection unit 81 equals to the voltage on the variable resistors. Therefore, the voltage on the thyristor P1 and protection unit 81 are relatively small due to the double voltage release mechanism. It avoids the mal-trip of thyristor and improves the anti-surging capability for RCD as a whole. Since most part of the surge voltage is carried by magnet, the variable resistor, thyristor and process unit are less influenced by the surge voltages.

The invention is not limited to the illustrated embodiments. The invention intends to include any possible modification based on the concept defined in the claims. Individual features may also be combined advantageously.

The invention claimed is:

1. A residual current protection device, comprising:

an arc extinguishing unit;

a current input terminal;

a current output terminal;

an arc guiding plate configured to guide an arc generated during contacts breaking to the arc extinguishing unit;

the arc extinguishing unit, including:

an arc extinguishing channel configured to extinguish the arc; and an enhanced arc extinguisher, disposed between the extinguishing channel and the arc guiding plate, for impelling the arc into the extinguishing channel;

wherein the arc guiding plate is configured to integrate with the current input terminal; and a static contact configured to integrate with the current output terminal.

2. The protection device according to claim 1, wherein the enhanced arc extinguisher includes an arc extinguishing plate configured to generate gas in a high temperature in order to increase an internal pressure of the protection device.

3. The protection device according to claim 2, wherein, the enhanced arc extinguisher includes a protruding portion on an inside surface of a housing of the protection device; and a magnetic field reinforcing element disposed within the protruding portion; wherein the magnetic field reinforcing element is configured to reinforce a magnetic field generated along with the arc, which accelerates the arc moving into the extinguishing channel.

4. The protection device according to claim 3, wherein the magnetic field reinforcing element disposed within the protruding portion is a bottom layer of the protruding portion that comprises an iron material, and the protruding portion further comprises a top layer of insulting material for protecting electronic components from being destroyed by the arc.

5. The protection device according to claim 1, further comprising:

a testing button configured to test a residual current protection of the protection device;

a PCB configured to detect the residual current and compare a detected value with a pre-determined value; and a power supplying unit configured to supply power to the PCB, which is configured to turn off the power supply to PCB when the residual current protection device is turned off.

6. The protection device according to claim 5, wherein, the PCB includes:

a main voltage releasing element, wherein the main voltage releasing element is configured to have a high inductive reactance in high frequency; and a secondary voltage releasing element, wherein the secondary voltage releasing element is configured to connect with the main voltage releasing element in series; and a residual current detecting and comparing unit configured to connect with the secondary voltage releasing element in parallel.

7. The protection device according to claim 6, wherein, the main voltage releasing element is a magnet; and the secondary voltage releasing element is a variable resistor.

8. The protection device according to claim 5, wherein, an insulting wall separates the arc extinguisher and the PCB;

a gas dissipating channel on the housing of protection device, which is configured to dissipate the gas generated by the arc extinguishing plate.

9. The protection device according to claim 8, wherein the insulting wall that separates the arc extinguisher and the PCB is an insulated ridge formed on an inside housing surface and extending between the arc extinguishing unit and the PCB, wherein the insulated ridge divides the internal space of the protection device into two chambers, a first chamber for arc extinguishing and second chamber for PCB, and wherein the insulated ridge prevents the arc from destroying electronics on the PCB.

10. The protection device according to claim 1, wherein the arc guiding plate is a single connecting conductor inserted into the current input terminal and through a zero sequence transformer.

11. The protection device according to claim 1, wherein the current output terminal is a single device that forms a static contact seat for fixing the static contact and a PCB power supply conductor.

12. The protection device according to claim 5, wherein the power supplying unit comprises a spring that has a left end connected via a live wire of an electric supply, a right end connected with the testing button and a neutral wire, and a bottom end connected to the PCB for power supply, wherein the left end and the bottom end are movable, and wherein the right end is static.

13. The protection device according to claim 12, wherein the power supplying unit spring supplies power to the testing button and to the PCB at the same time.

14. The protection device according to claim 13, wherein, via operation of the power supplying unit spring, the PCB is power-off when the protection device is in an open phase.

15. The protection device according to claim 6, wherein, the main voltage releasing element is a magnet; and the secondary voltage releasing element comprises a first variable resistor serially connected to a part of the magnet via a tap on the magnet, and a second variable resistor serially connected to the magnet;

wherein the first and the second variable resistors are disposed in parallel connection to each other relative to the magnet.

16. The protection device according to claim 15, wherein the testing button connects with the first variable resistor in parallel.

17. The protection device according to claim 16, wherein the residual current detecting and comparing unit connects with the first and the second variable resistors in parallel and thereby has a same potential as that of the first and the second variable resistors.

18. The protection device according to claim 17, further comprising:

a thyristor connected at a first end with the magnet, and at a second end with ground.

19. The protection device according to claim 18, wherein the current input terminal is a live wire, the current output terminal is a neutral wire, and the testing button is a first switch that connects the live wire to the magnet via another resistor; and further comprising:

a zero sequence transformer disposed closed to the current input terminal and the current output terminal, wherein a value of voltage detected by the zero sequence transformer is sent to a transformer processing unit; and a second switch that connects the magnet to the neutral wire via the zero sequence transformer, and the first variable resistor and the second variable resister to the live wire via the zero sequence transformer;

wherein, when the testing button is closed, an additional current is introduced from the live wire for performing a residual current protection test.

* * * * *